US008843041B2

(12) United States Patent
Matsumoto et al.

(10) Patent No.: US 8,843,041 B2
(45) Date of Patent: Sep. 23, 2014

(54) FIXING DEVICE AND IMAGE FORMING APPARATUS

(71) Applicant: Fuji Xerox Co., Ltd., Toyko (JP)

(72) Inventors: Mitsuhiro Matsumoto, Kanagawa (JP); Hiromi Nagai, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 159 days.

(21) Appl. No.: 13/661,426

(22) Filed: Oct. 26, 2012

(65) Prior Publication Data

US 2013/0236219 A1 Sep. 12, 2013

(30) Foreign Application Priority Data

Mar. 12, 2012 (JP) ..... 2012-054534

(51) Int. Cl.
*G03G 15/20* (2006.01)

(52) U.S. Cl.
CPC ..... *G03G 15/2075* (2013.01)
USPC ..... 399/327

(58) Field of Classification Search
USPC ..... 399/327, 326, 347
See application file for complete search history.

(56) References Cited

U.S. PATENT DOCUMENTS

| | | | | |
|---|---|---|---|---|
| 7,233,764 | B2 * | 6/2007 | Naito et al. | 399/329 |
| 2002/0136572 | A1 * | 9/2002 | Kaji et al. | 399/327 |
| 2011/0299897 | A1 * | 12/2011 | Onodera et al. | 399/327 |
| 2013/0236223 | A1 * | 9/2013 | Matsumoto et al. | 399/329 |
| 2013/0236224 | A1 * | 9/2013 | Matsumoto et al. | 399/329 |

FOREIGN PATENT DOCUMENTS

| | | | |
|---|---|---|---|
| JP | 63-155073 | A | 6/1988 |
| JP | 2006-91182 | A | 4/2006 |
| JP | 2007-114698 | A | 5/2007 |

* cited by examiner

*Primary Examiner* — Walter L Lindsay, Jr.
*Assistant Examiner* — Rodney Bonnette
(74) *Attorney, Agent, or Firm* — Sughrue Mion, PLLC

(57) ABSTRACT

A fixing device includes a heat assembly including an endless belt, a heat source, a pressure pad, and a cleaning member that cleans an inner surface of the endless belt as the result of circulation movement of the endless belt; and a pressure member that presses an outer surface of the endless belt. The cleaning member contacts the endless belt with a contact-pressure distribution such that a contact pressure of a portion located downstream of a most upstream portion in a moving direction of the endless belt is the maximum in a contact region where the cleaning member contacts the endless belt.

4 Claims, 6 Drawing Sheets

FIXING DEVICE AND IMAGE FORMING APPARATUS

CROSS-REFERENCE TO RELATED APPLICATIONS

This application is based on and claims priority under 35 USC 119 from Japanese Patent Application No. 2012-054534 filed Mar. 12, 2012.

BACKGROUND

The present invention relates to a fixing device and an image forming apparatus.

SUMMARY

According to an aspect of the invention, there is provided a fixing device including a heat assembly including an endless belt that moves in a circulation manner and has an inner surface and an outer surface, a heat source that heats the endless belt, a pressure pad that is pressed to the inner surface of the endless belt, and a cleaning member that cleans the inner surface of the endless belt by contacting the inner surface and sliding on the inner surface as the result of the circulation movement of the endless belt; and a pressure member that presses the outer surface of the endless belt to the pressure pad, receives a medium that holds an unfixed toner image between the pressure member and the endless belt, and fixes the toner image to the medium in cooperation with the heat assembly. The cleaning member contacts the endless belt with a contact-pressure distribution such that a contact pressure of a portion located downstream of a most upstream portion in a moving direction of the endless belt is the maximum in a contact region where the cleaning member contacts the endless belt.

BRIEF DESCRIPTION OF THE DRAWINGS

Exemplary embodiments of the present invention will be described in detail based on the following figures, wherein.

DETAILED DESCRIPTION

Exemplary embodiments are described below with reference to the drawings.

First, a first exemplary embodiment is described.

Figure 1:
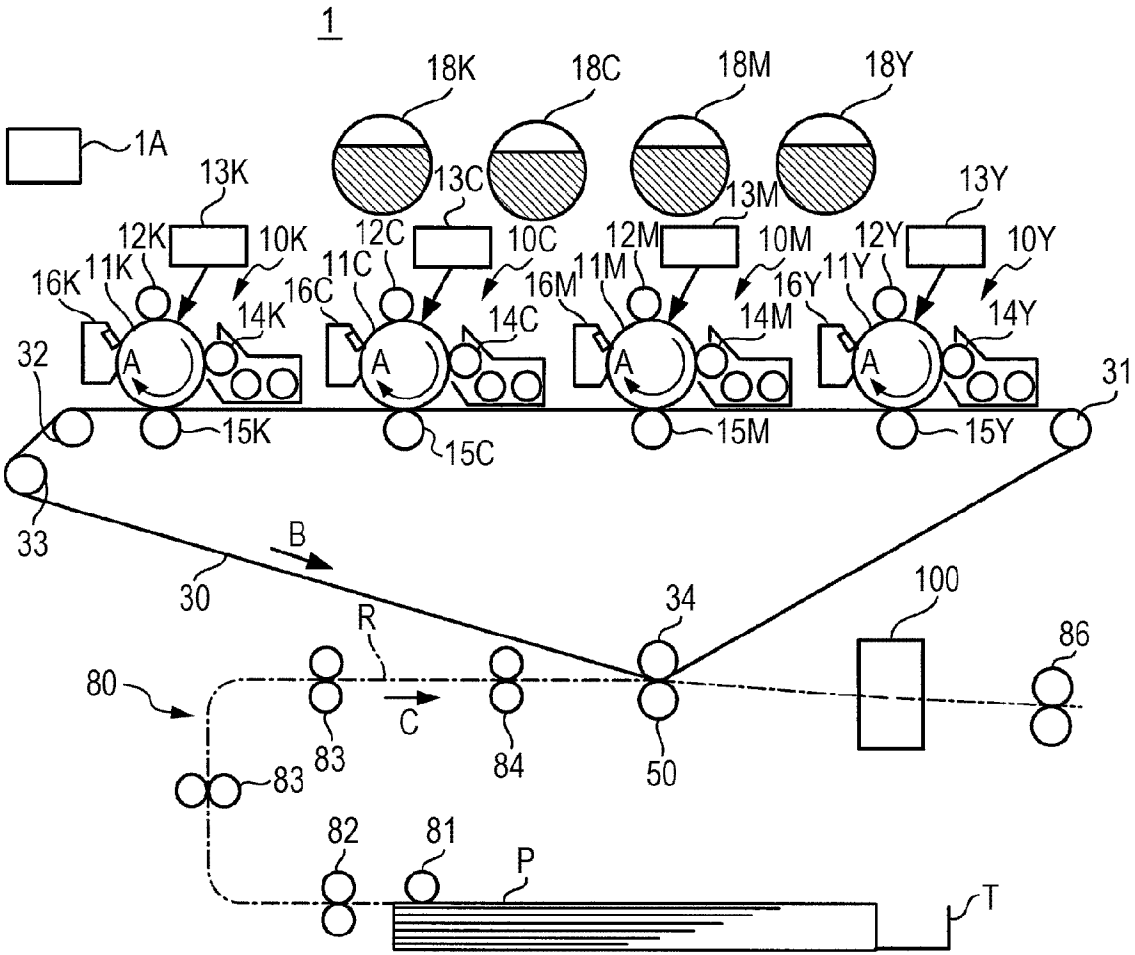
FIG. 1 is a configuration diagram showing an image forming apparatus according to a first exemplary embodiment of the present invention.

FIG. 1 is a configuration diagram showing an image forming apparatus 1 according to the first exemplary embodiment of the present invention.

The image forming apparatus 1 is a tandem color printer in which image forming units 10Y, 10M, 10C, and 10K of respective colors including yellow (Y), magenta (M), cyan (C), and black (K) are arranged in parallel. The image forming apparatus 1 executes printing of a monochrome image, and also executes printing of a full-color image formed of four-color toner images. Toner cartridges 18Y, 18M, 18C, and 18K house toners of the respective YMCK colors. The toners have, for example, an average particle diameter ranging from 2 to 7 μm, and a diameter of an equivalent circle ranging from 0.95 to 1.0. Also, the toner cartridges 18Y, 18M, 18C, and 18K contain a lubricant as an additive of the toners.

The four image forming units 10Y, 10M, 10C, and 10K have configurations being substantially equivalent to each other. Hence, the image forming unit 10Y corresponding to yellow is representatively described. The image forming unit 10Y includes a photoconductor 11Y, a charging unit 12Y, an exposure unit 13Y, a developing unit 14Y, and a first transfer unit 15Y. Also, a photoconductor cleaner 16Y is provided at the image forming unit 10Y. The photoconductor cleaner 16Y cleans the photoconductor 11Y.

The photoconductor 11Y is a drum having a cylindrical base body and a photoconductor layer provided on the surface of the base body. The photoconductor 11Y holds an image that is formed on the surface, and rotates around the axis of the cylinder, i.e., in a direction indicated by arrow A. The charging unit 12Y, the exposure unit 13Y, the developing unit 14Y, the first transfer unit 15Y, and the photoconductor cleaner 16Y are successively arranged around the photoconductor 11Y in the order of the direction indicated by arrow A.

The charging unit 12Y causes the surface of the photoconductor 11Y to be electrically charged. The charging unit 12Y is a charging roller that contacts the surface of the photoconductor 11Y. A voltage with the same polarity as the polarity of the toner in the developing unit 14Y is applied to the charging unit 12Y, and causes the surface of the photoconductor 11Y contacting the charging unit 12Y to be electrically charged. The exposure unit 13Y radiates the photoconductor 11Y with exposure light and hence causes the surface of the photoconductor 11Y to be exposed to the light. The exposure unit 13Y emits laser light in accordance with an image signal supplied from the outside of the image forming apparatus 1, and scans the surface of the photoconductor 11Y with the laser light.

The developing unit 14Y uses a developer and develops the surface of the photoconductor 11Y. The toner is supplied to the developing unit 14Y from the toner cartridge 18Y. The developing unit 14Y stirs the developer in which a magnetic carrier and a toner are mixed, and hence causes the toner and the magnetic carrier to be electrically charged. The developing unit 14Y develops the surface of the photoconductor 11Y with the electrically charged toner. The first transfer unit 15Y is a roller that faces the photoconductor 11Y with an intermediate transfer belt 30 interposed therebetween. The first transfer unit 15Y applies a voltage to the photoconductor 11Y and hence transfers a toner image on the photoconductor 11Y onto the intermediate transfer belt 30.

The photoconductor cleaner 16Y cleans the surface of the photoconductor 11Y by removing the toner (a residual toner) remaining at a portion subjected to the transfer from among the surface of the photoconductor 11Y by the first transfer unit 15Y.

The image forming apparatus 1 also includes the intermediate transfer belt 30, a fixing device 100, a sheet transport unit 80, and a controller 1A. The intermediate transfer belt 30 is an endless belt wound around belt support rollers 31 to 34. The intermediate transfer belt 30 moves in a circulation manner in a direction indicated by arrow B that passes through the image forming units 10Y, 10M, 10C, and 10K and a second transfer unit 50. Toner images of the respective colors are transferred on the intermediate transfer belt 30 from the image forming units 10Y, 10M, 10C, and 10K. The intermediate transfer belt 30 moves while holding the toner images of the respective colors.

The second transfer unit 50 is a roller that pinches the intermediate transfer belt 30 and a sheet P between the second transfer unit 50 and a backup roller 34 that is one of the belt support rollers 31 to 34. The second transfer unit 50 applies a voltage that is a reverse polarity being reverse to the charging polarity of the toner and hence transfers the toner images on the intermediate transfer belt 30 onto the sheet P.

A combination of the image forming units 10Y, 10M, 10C, and 10K, the intermediate transfer belt 30, and the second transfer unit 50 corresponds to an example of an image forming unit according to an exemplary embodiment of the present invention.

The fixing device 100 fixes the toner images to the sheet P. The fixing device 100 corresponds to a fixing device according to an exemplary embodiment of the present invention. The fixing device 100 also corresponds to a fixing unit included in an image forming apparatus according to an exemplary embodiment of the present invention. The fixing device 100 is described later in detail.

The sheet transport unit 80 includes a pickup roller 81 that picks up sheets P housed in a sheet housing container T, a separation roller 82 that separates the picked-up sheets P, and a transport roller 83 that transports the separated sheet P. The sheet transport unit 80 further includes a registration roller 84 that transports the sheet P to the second transfer unit 50, and an output roller 86 that outputs the sheet P to the outside. The sheet transport unit 80 transports the sheet P along a sheet transport path R that passes through the second transfer unit 50 and the fixing device 100.

A basic operation of the image forming apparatus 1 shown in FIG. 1 is described. In the image forming unit 10Y corresponding to yellow, the photoconductor 11Y rotates in the direction indicated by arrow A, and the surface of the photoconductor 11Y is electrically charged by the charging unit 12Y. The exposure unit 13Y radiates the surface of the photoconductor 11Y with exposure light in accordance with an image signal corresponding to yellow from among image signals supplied from the outside. Hence, the exposure unit 13Y forms an electrostatic latent image on the surface of the photoconductor 11Y. The developing unit 14Y receives the supply of the yellow toner from the toner cartridge 18Y, and develops the electrostatic latent image on the photoconductor 11Y with the toner. Thus, the developing unit 14Y forms the toner image. The photoconductor 11Y rotates while holding the yellow toner image formed on the surface. The first transfer unit 15Y transfers the toner image formed on the surface of the photoconductor 11Y onto the intermediate transfer belt 30. After the transfer, the photoconductor cleaner 16Y removes the residual toner remaining on the photoconductor 11Y.

The intermediate transfer belt 30 moves in a circulation manner in the direction indicated by arrow B. The image forming units 10M, 10C, and 10K corresponding to the colors except yellow form toner images corresponding to the respective colors, in a manner similar to the image forming unit 10Y. The toner images of the respective colors are successively transferred on the intermediate transfer belt 30, and superposed on the toner image transferred by the image forming unit 10Y.

The pickup roller 81 picks up a sheet P from the sheet housing container T. The transport roller 83 and the registration roller 84 transport the sheet P through the sheet transport path R in a direction indicated by arrow C toward the second transfer unit 50. The registration roller 84 sends the sheet P to the second transfer unit 50 in accordance with a timing at which the toner images are transferred on the intermediate transfer belt 30. The second transfer unit 50 transfers the toner images on the intermediate transfer belt 30 onto the sheet P. The sheet P with the toner images transferred thereon is transported to the fixing device 100. The fixing device 100 fixes the toner images transferred on the sheet P to the sheet P. In this way, an image is formed on the sheet P. The output roller 86 outputs the sheet P with the image formed thereon to the outside of the image forming apparatus 1.

Next, the fixing device 100 is described.

Figure 2:
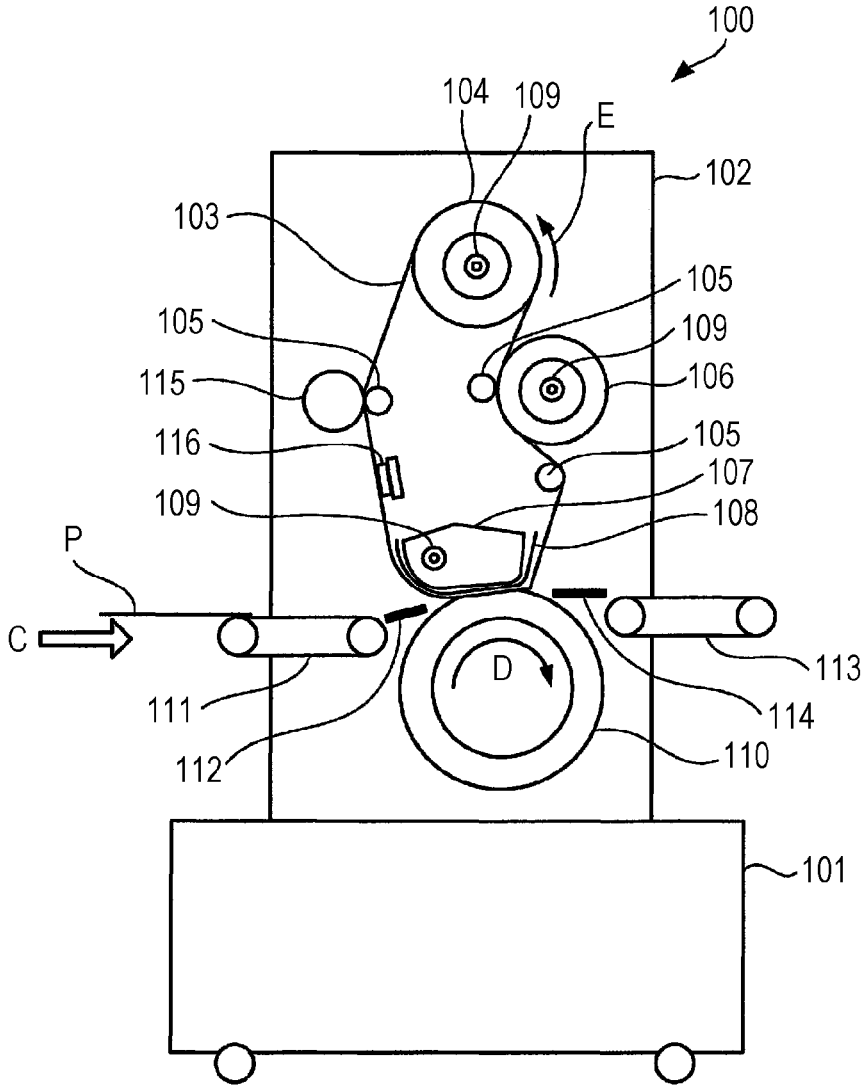
FIG. 2 schematically illustrates a brief inner structure of a fixing device.

FIG. 2 schematically illustrates a brief inner structure of the fixing device 100.

The fixing device 100 includes a base 101, a frame 102, an endless belt 103, a tension roller 104, three positioning rollers 105, an external heat roller 106, a fixing pad 107, and a slide sheet 108.

The fixing device 100 is removably mounted on the image forming apparatus 1 in FIG. 1. The image forming apparatus 1 has a guide frame (not shown) that receives and supports the fixing device 100. The base 101 of the fixing device 100 is removably supported along the guide frame. The frame 102 of the fixing device 100 is constructed on the base 101.

The tension roller 104, the three positioning rollers 105, and the external heat roller 106 are rotatably supported by the frame 102. In contrast, the fixing pad 107 is fixed to the frame 102.

The endless belt 103 is wound around the tension roller 104 and the three positioning rollers 105. Further, the fixing pad 107 is pressed to the inner surface of the endless belt 103. The external heat roller 106 is rotatably supported at the frame 102 with the endless belt 103 interposed between the external heat roller 106 and the positioning roller 105 at the upper right side in the drawing from among the three positioning rollers 105.

The endless belt 103 is formed by providing a silicone rubber layer with a thickness ranging from 300 to 600 μm and a release layer with a thickness ranging from 20 to 50 μm on a base member with a thickness ranging from 70 to 100 μm made of polyimide. The release layer is formed of a fluorine resin material, such as perfluoroalkoxy alkane (PFA), having a high release property. The inner surface of the endless belt 103 is treated by rough-surface processing by decreasing the contact area of the inner surface of the endless belt 103 with respect to the tension roller 104, the positioning rollers 105, and the slide sheet 108, to reduce a frictional resistance of the inner surface of the endless belt 103 with respect to these members.

The fixing pad 107 has a substantially rectangular parallelepiped shape extending in a direction orthogonal to the paper face. The fixing pad 107 is pressed to the inner surface of the endless belt 103.

Also, the slide sheet 108 is fixed to the fixing pad 107 in a state in which the slide sheet 108 is pinched between the fixing pad 107 and the endless belt 103.

The slide sheet 108 is formed of a fluorine resin material, such as polytetrafluoroethylene (PTFE), which is a low-friction material, to reduce a frictional resistance with respect to the endless belt 103. The slide sheet 108 has a thickness ranging from 200 to 500 μm to reduce a shear force and a creep amount.

Also, heaters 109 that heat the endless belt 103 are respectively provided in the tension roller 104, the external heat roller 106, and the fixing pad 107. The endless belt 103 corresponds to an example of an endless belt according to an exemplary embodiment of the present invention. The fixing pad 107 corresponds to an example of a pressure pad according to an exemplary embodiment of the present invention. The heater 109 corresponds to an example of a heat source according to an exemplary embodiment of the present invention.

In the fixing device 100, a pressure roller 110 is rotatably supported at the frame 102 so that the pressure roller 110 presses the outer surface of the endless belt 103 to the fixing pad 107. With the pressure of the pressure roller 110, a nip region for pinching a sheet P is formed between the pressure roller 110 and the endless belt 103 with the fixing pad 107 pressed to the inner surface of the endless belt 103.

The pressure roller 110 is rotationally driven in a direction indicated by arrow D by a driving mechanism (not shown in FIG. 2) while the nip region is formed. The pressure roller 110 corresponds to an example of a pressure member according to an exemplary embodiment of the present invention.

When the pressure roller 110 rotates, the endless belt 103 is driven by the rotation of the pressure roller 110 and moves in a circulation manner in a direction indicated by arrow E. During the circulation movement, the slide sheet 108 slides on the inner surface of the endless belt 103. The slide sheet 108 corresponds to an example of a slide sheet according to an exemplary embodiment of the present invention. A combination of the endless belt 103, the fixing pad 107, the heaters 109, and the slide sheet 108 corresponds to an example of a heat assembly according to an exemplary embodiment of the present invention.

The fixing device 100 includes an entrance-side transport belt 111 that transports a sheet P, which is transported in the direction indicated by arrow C (also shown in FIG. 1) and holds an unfixed toner image, toward the entrance of the nip region. An entrance-side guide portion 112 is arranged between the entrance-side transport belt 111 and the entrance of the nip region. The entrance-side guide portion 112 guides the sheet P to the entrance of the nip region. The entrance-side transport belt 111 and the entrance-side guide portion 112 send the sheet P to the nip region.

The sheet P sent to the nip region is heated by the endless belt 103 heated by the heaters 109, is pressed by the pressure roller 110, and is transported to the exit of the nip region. The toner image held on the sheet P is fixed to the sheet P by the heat and pressure applied from the endless belt 103 and the pressure roller 110 while the sheet P passes through the nip region.

An exit-side transport belt 113 and an exit-side guide portion 114 are arranged at the exit of the nip region. The exit-side transport belt 113 transports the sheet P toward the output roller 86 shown in FIG. 1. The exit-side guide portion 114 guides the sheet P from the exit of the nip region to the exit-side transport belt 113. The sheet P after the toner image is fixed is transported to the output roller 86 by these members.

The fixing device 100 also includes a cleaning roller 115 at a position at which the endless belt 103 is pinched between the cleaning roller 115 and the positioning roller 105 at the left side in the drawing from among the three positioning rollers 105. The cleaning roller 115 removes a foreign substance adhering to the outer surface of the endless belt 103 after the toner image is fixed.

Further, an inner-surface cleaning member 116 is arranged between the positioning roller 105 at the left side in the drawing and the fixing pad 107. The inner-surface cleaning member 116 contacts the inner surface of the endless belt 103 and removes a foreign substance, such as wear powder, adhering to the inner surface of the endless belt 103. The inner-surface cleaning member 116 is removably fixed to the frame 102. The life of the inner-surface cleaning member 116 is predetermined as described later. The inner-surface cleaning member 116, which has reached the end of life, is replaced with new one by a maintenance personnel. The inner-surface cleaning member 116 corresponds to a cleaning member according to an exemplary embodiment of the present invention.

The inner-surface cleaning member 116 is impregnated with lubrication oil to reduce the frictional resistance between the inner surface of the endless belt 103 and the slide sheet 108 etc. The inner-surface cleaning member 116 also applies the lubrication oil to the inner surface of the endless belt 103. The inner surface of the endless belt 103 treated by the rough-surface processing as described above holds the applied lubrication oil on the rough surface and maintains lubricity.

Figure 3:
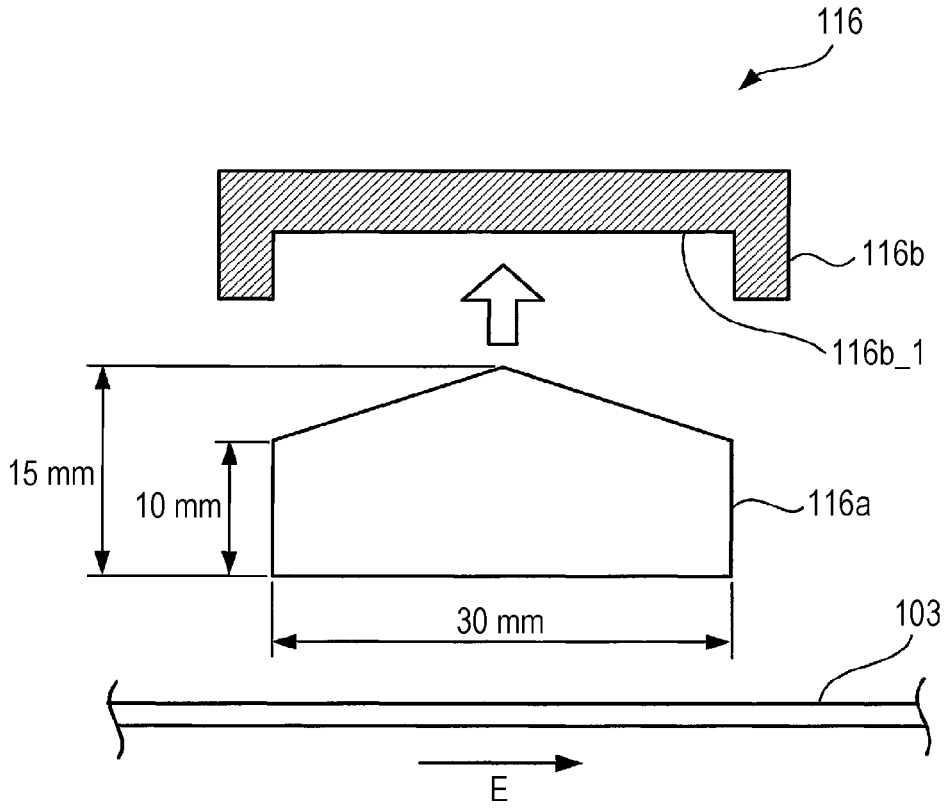
FIG. 3 is an exploded view schematically showing an inner-surface cleaning member shown in FIG. 2.

FIG. 3 is an exploded view schematically showing the inner-surface cleaning member 116 shown in FIG. 2.

The inner-surface cleaning member 116 includes a contact member 116*a* that contacts the inner surface of the endless belt 103, and a holding member 116*b* that holds the contact member 116*a* and presses the contact member 116*a* to the inner surface of the endless belt 103. FIG. 3 illustrates a cross section of the contact member 116*a* and the holding member 116*b* taken along a moving direction of the endless belt 103 (also shown in FIG. 2) (in a direction indicated by arrow E). The contact member 116*a* corresponds to an example of a contact member according to an exemplary embodiment of the present invention. The holding member 116*b* corresponds to an example of a holding member according to an exemplary embodiment of the present invention.

The contact member 116*a* is formed of a foam body and is impregnated with lubrication oil. The contact member 116*a* has a width of 30 mm in the direction indicated by arrow E. Also, the contact member 116*a* has the same width in the direction orthogonal to the paper face as the width of the endless belt 103. Further, the contact member 116*a* has both end portions and a center portion, and has a thickness distribution such that the thickness of each of the both end portions is 10 mm in the direction indicated by arrow E, the thickness gradually increases to the center portion so as to protrude toward the holding member 116*b*, and the thickness of the center portion is 15 mm.

The holding member 116*b* has a recess 116*b*_1 that houses the contact member 116*a*. The holding member 116*b* is fixed to the frame 102 shown in FIG. 2 in a posture that the bottom surface of the recess 116*b*_1 is substantially parallel to the inner surface of the endless belt 103. The contact member 116*a* is fitted to the recess 116*b*_1 of the holding member 116*b* fixed as described above. The contact member 116*a* is pressed to the inner surface of the endless belt 103 by the holding member 116*b*.

Figure 4A:
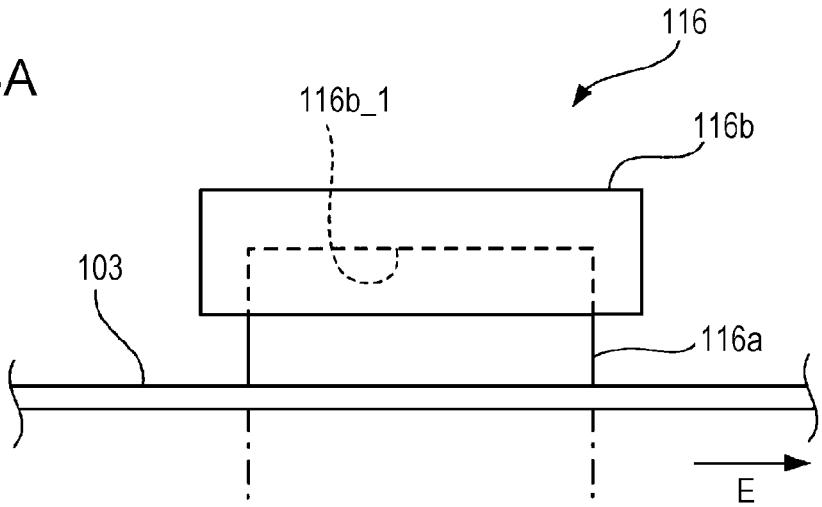
FIGS. 4A and 4B illustrate the inner-surface cleaning member in a state in which a contact member is pressed to the inner surface of an endless belt.
Figure 4B:
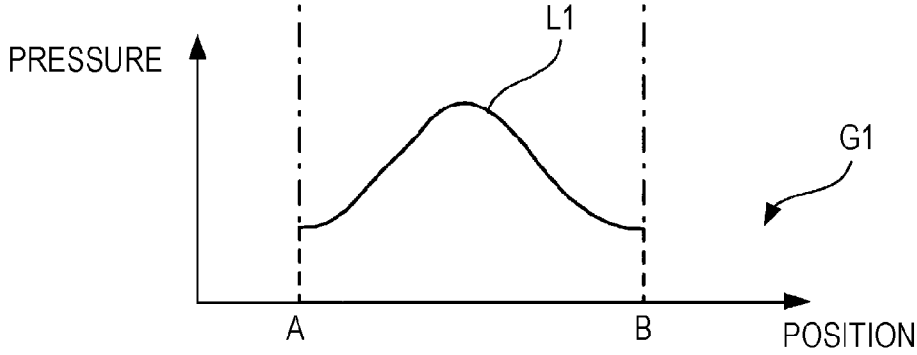

FIGS. 4A and 4B illustrate the inner-surface cleaning member 116 in a state in which the contact member 116*a* is pressed to the inner surface of the endless belt 103.

FIG. 4A illustrates the inner-surface cleaning member 116. FIG. 4B illustrates a graph G1 indicative of a contact-pressure distribution in a contact region A-B where the contact member 116*a* contacts the inner surface of the endless belt 103. In the graph G1, the horizontal axis plots the position in the moving direction of the endless belt 103 (the direction indicated by arrow E), and the vertical axis plots the contact pressure at each position. In the graph G1, a solid line L1 indicates the contact-pressure distribution in the contact region A-B.

As described above, the contact member 116*a* is formed of the foam body. Hence, when the contact member 116*a* is fitted to the recess 116*b*_1 having the bottom surface being substantially parallel to the inner surface of the endless belt 103 and is pressed to the inner surface of the endless belt 103, the contact member 116*a* is elastically deformed. The contact member 116*a* has the thickness distribution as shown in FIG. 3 in the direction indicated by arrow E. The deformation amount by the above-mentioned elastic deformation increases toward the center portion. As the result, the contact-pressure distribution in the contact region A-B exhibits a distribution in which the contact pressure gradually increases toward the center portion and becomes the maximum at the center portion as indicated by the solid line L1 in the graph G1.

The inner surface of the endless belt 103 has a frictional resistance with respect to the slide sheet 108 etc., the frictional resistance which is reduced by the above-described rough-surface processing and the lubrication oil applied by the inner-surface cleaning member 116. While the fixing device 100 is used for a long term, the inner surface of the endless belt 103 wears and generates wear powder by the contact with respect to the slide sheet 108 etc. although only slightly.

If the fixing device 100 does not include the inner-surface cleaning member 116 shown in FIG. 4A etc. and the wear powder continuously adheres to the inner surface of the endless belt 103, the frictional resistance with respect to the slide sheet 108 etc. increases as the wear powder increases. Also, if the lubrication oil at the inner surface of the endless belt 103, the lubrication oil which should reduce the frictional resistance, is mixed with the wear powder, the viscosity of the lubrication oil may increase, and the lubrication oil may increase the frictional resistance with respect to the slide sheet 108 etc. Further, the inner surface of the endless belt 103 treated by the rough-surface processing to decrease the contact area with respect to the slide sheet 108 etc. may promote the generation of the wear powder in view of the generation of the wear powder.

The inner-surface cleaning member 116 removes the wear powder from the inner surface of the endless belt 103. The removed wear powder is accumulated in the contact member 116*a* formed of the foam body. The life of the inner-surface cleaning member 116 is predetermined as a period until the accumulation amount of the wear powder reaches the upper limit of a permissible amount. The contact member 116*a* is impregnated with the lubrication oil by an amount that may be continuously applied to the inner surface of the endless belt 103 until the inner-surface cleaning member 116 reaches the end of the predetermined life. As described above, the inner-surface cleaning member 116 which has reached the end of life is replaced with new one by the maintenance personnel.

Majority of the wear powder is mixture of wear powder with a small particle diameter in a range from 3 to 4 μm and wear powder with a large particle diameter in a range from 4 to 15 μm. When the wear powder is removed by a member that contacts the surface of a subject of removal, a larger contact pressure is generally required for removal of the wear powder with the small particle diameter than the contact pressure for removal of the wear powder with the large particle diameter.

With the inner-surface cleaning member 116, the gap between the holding member 116*b* and the inner surface of the endless belt 103 is determined so that the contact pressure at both end portions in the contact region A-B shown in FIGS. 4A and 4B is sufficient for the removal of the wear power with the large particle diameter. Also, the contact member 116*a* shown in FIG. 3 has a dimension at the center portion determined such that the contact pressure at the center portion in the contact region A-B is sufficient for the removal of the wear powder with the small particle diameter.

With the inner-surface cleaning member 116, the wear powder with the large particle diameter is mostly removed by the contact member 116*a* at a portion around an upstream end in the moving direction of the endless belt 103 (the direction indicated by arrow E) in the contact region A-B shown in FIGS. 4A and 4B. At this time, major part of the wear powder with the small particle diameter passes through the portion around the upstream end because of insufficiency in contact pressure. The passed wear powder with the small particle diameter is removed by the contact member 116*a* at the center portion in the contact region A-B.

Also, as described above, with the inner-surface cleaning member 116, the relatively large contact pressure sufficient for the removal of the wear powder with the small particle diameter is provided only at the center portion in the contact region A-B shown in FIGS. 4A and 4B. If the contact pressure in the entire contact region A-B is the large contact pressure, wear may occur between the inner-surface cleaning member 116 and the inner surface of the endless belt 103. With the inner-surface cleaning member 116, the portion with the large contact pressure is limited. Hence, occurrence of wear is restricted.

Further, with the inner-surface cleaning member 116, the contact pressure at the upstream end portion in the moving direction of the endless belt 103 (in the direction indicated by arrow E) in the contact region A-B is restricted to be a relatively small contact pressure sufficient for the removal of the wear powder with the large particle diameter. If the contact pressure at the upstream end portion is the relatively large contact pressure sufficient for the removal of the wear powder with the small particle diameter, the amount of the wear powder that is removed at the portion around the upstream end becomes excessively large. Then, the wear powder is accumulated at the portion around the upstream end of the contact member 116*a* by an amount larger than a permissible amount in a short period of time. As the result, the life of the inner-surface cleaning member 116 may become short.

In contrast, with the inner-surface cleaning member 116, the wear powder with the large particle diameter is removed mostly by the portion around the upstream end of the contact member 116*a*, and the wear powder with the small particle diameter is removed by the center portion of the contact member 116*a*. As described above, with the inner-surface cleaning member 116, the portion at which the wear powder is accumulated in the contact member 116*a* is dispersed, and a local increase in accumulation amount of the wear powder is restricted.

Also, with the inner-surface cleaning member 116, the contact-pressure distribution is provided by a simple structure of a thickness distribution of the contact member 116*a* in the moving direction of the endless belt 103 (in the direction indicated by arrow E).

In the above-described first exemplary embodiment, the thickness distribution in which the thickness gradually increases from both ends to the center portion in the moving direction of the endless belt is described as an example of a thickness distribution according to an exemplary embodiment of the present invention. However, the thickness distribution according to an exemplary embodiment of the present invention is not limited thereto. For example, a thickness distribution in which the thickness gradually increases from a most upstream portion to a most downstream portion in the moving direction of the endless belt may be employed. Alternatively, a thickness distribution in a step form in which the thickness of a portion located downstream of the most upstream portion in the moving direction of the endless belt is locally larger than that of the other portion may be employed.

Also, in the first exemplary embodiment, the thickness distribution in which the thickness of the portion located downstream of the most upstream portion in the moving direction of the endless belt increases toward the holding member is provided as an example of a thickness distribution according to an exemplary embodiment of the present invention. However, the thickness distribution according to an exemplary embodiment of the present invention is not limited thereto. For example, a thickness distribution in which the thickness of the portion located downstream of the most upstream portion in the moving direction of the endless belt increases toward the endless belt may be employed.

Next, a second exemplary embodiment is described.

The configurations of the image forming apparatus and the fixing device according to the second exemplary embodiment are similar to those of the first exemplary embodiment except the inner-surface cleaning member. Thus, illustration and description for the configurations of the image forming apparatus and the fixing device according to the second exemplary embodiment are omitted, and description is given in a focused manner for an inner-surface cleaning member that differs from that of the first exemplary embodiment.

The following description occasionally refer FIGS. 1 and 2 showing the image forming apparatus 1 and the fixing device 100 according to the first exemplary embodiment.

Figure 5:
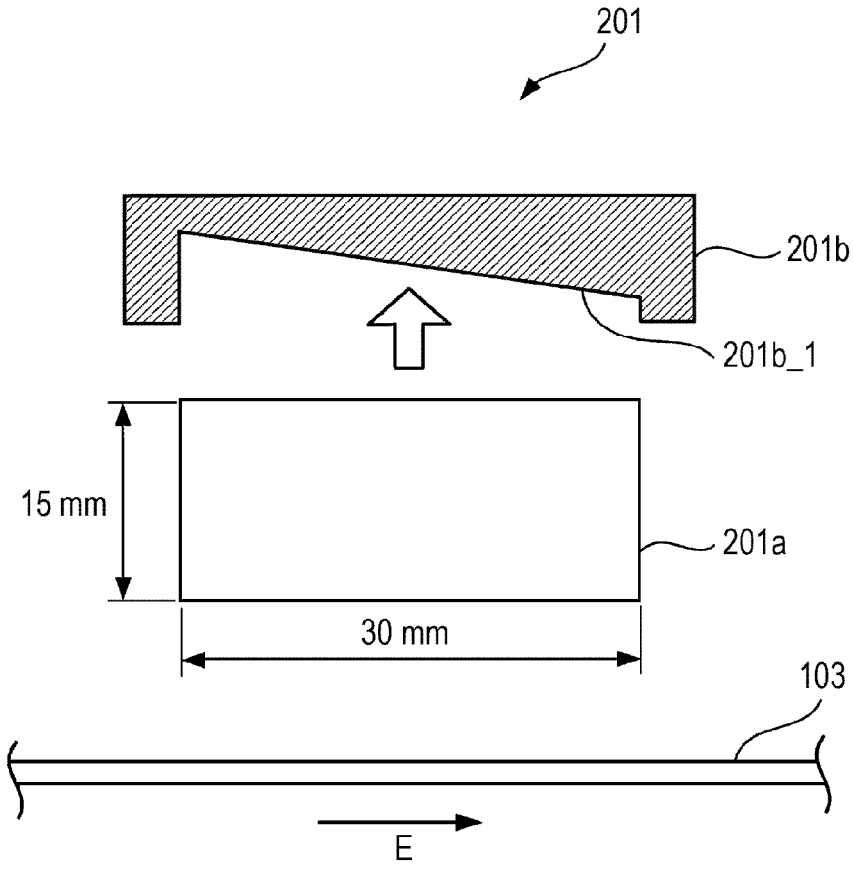
FIG. 5 is an exploded view schematically showing an inner-surface cleaning member according to a second exemplary embodiment.

FIG. 5 is an exploded view schematically showing an inner-surface cleaning member 201 according to the second exemplary embodiment.

The inner-surface cleaning member 201 shown in FIG. 5 includes a contact member 201*a* that contacts the inner surface of the endless belt 103, and a holding member 201*b* that holds the contact member 201*a* and presses the contact member 201*a* to the inner surface of the endless belt 103. FIG. 5 illustrates a cross section of the contact member 201*a* and the holding member 201*b* taken along the moving direction of the endless belt 103 (also shown in FIG. 2) (in the direction indicated by arrow E). The contact member 201*a* corresponds to an example of a contact member according to an exemplary embodiment of the present invention. The holding member 201*b* corresponds to an example of a holding member according to an exemplary embodiment of the present invention.

The contact member 201*a* is formed of a foam body and is impregnated with lubrication oil. The contact member 201*a* has a width of 30 mm in the direction indicated by arrow E. Also, the contact member 201*a* has the same width in the direction orthogonal to the paper face as the width of the endless belt 103. Further, the contact member 201*a* has a constant thickness of 15 mm.

The holding member 201*b* is fixed to the frame 102 shown in FIG. 2 such that an upper surface of the holding member 201*b* at a side opposite to a surface near the inner surface of the endless belt 103 is substantially parallel to the inner surface of the endless belt 103. The holding member 201*b* has a recess 201*b*_1 that houses the contact member 201*a*. The depth of the recess 201*b*_1 gradually decreases from the upstream side to the downstream side in the moving direction of the endless belt 103 (in the direction indicated by arrow E).

The contact member 201*a* is fitted to the recess 201*b*_1 of the holding member 201*b* fixed to the frame 102 as described above. The contact member 201*a* is pressed to the inner surface of the endless belt 103 by the holding member 201*b*.

Figure 6A:
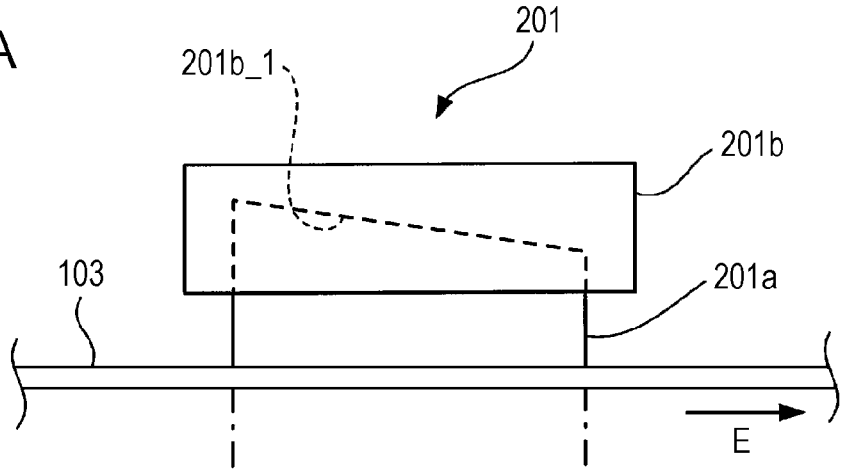
FIGS. 6A and 6B illustrate the inner-surface cleaning member in a state in which a contact member is pressed to the inner surface of an endless belt.
Figure 6B:
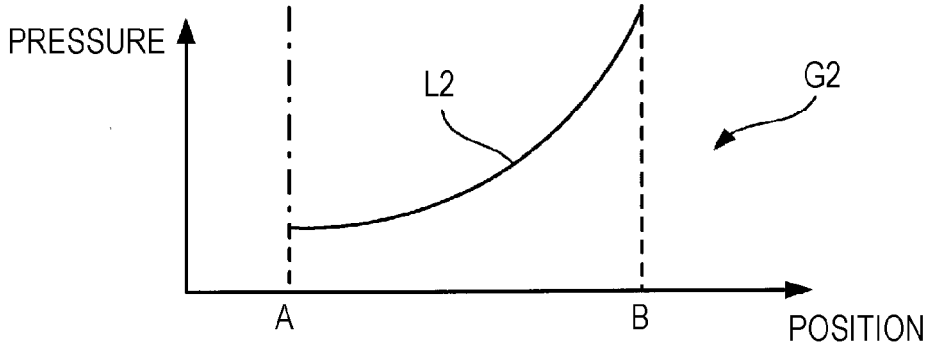

FIGS. 6A and 6B illustrate the inner-surface cleaning member 201 in a state in which the contact member 201*a* is pressed to the inner surface of the endless belt 103.

FIG. 6A illustrates the inner-surface cleaning member 201. FIG. 6B illustrates a graph G2 indicative of a contact-pressure distribution in a contact region A-B where the contact member 201*a* contacts the inner surface of the endless belt 103. In the graph G2, the horizontal axis plots the position in the moving direction of the endless belt 103 (the direction indicated by arrow E), and the vertical axis plots the contact pressure at each position. In the graph G2, a solid line L2 indicates the contact-pressure distribution in the contact region A-B.

The depth of the recess 201*b*_1 of the holding member 201*b* gradually decreases from the upstream side to the downstream side in the moving direction of the endless belt 103 (in the direction indicated by arrow E). Owing to this, the holding member 201*b* presses the contact member 201*a* fitted to the recess 201*b*_1 to the inner surface of the endless belt 103 with a press-pressure distribution described below. That is, the press-pressure distribution is a distribution in which the pressure gradually increases from the upstream side to the downstream side in the moving direction of the endless belt 103 (in the direction indicated by arrow E).

As described above, the contact member 201*a* is formed of the foam body. Owing to this, the contact member 201*a* is elastically deformed when the contact member 201*a* is pressed to the inner surface of the endless belt 103 by the holding member 201*b*. With the press-pressure distribution, the deformation amount of the elastic deformation increases toward a downstream end portion in the moving direction of the endless belt 103 (in the direction indicated by arrow E).

As the result, the contact-pressure distribution in the contact region A-B is a distribution in which the contact pressure gradually increases from the upstream side to the downstream side in the moving direction of the endless belt 103 (in the direction indicated by arrow E) and becomes the maximum at the downstream end portion as indicated by the solid line L2 of the graph G2.

With the inner-surface cleaning member 201, the gap between the holding member 201*b* and the inner surface of the endless belt 103 is determined so that the contact pressure of a most upstream portion in the moving direction of the endless belt 103 (in the direction indicated by arrow E) in the contact region A-B shown in FIGS. 6A and 6B is sufficient for the removal of the wear power with the large particle diameter.

Also, inclination of the bottom surface of the recess 201*b*_1 of the holding member 201*b* is an inclination in which the contact pressure of a most downstream portion in the moving direction of the endless belt 103 (in the direction indicated by arrow E) in the contact region A-B is sufficient for the removable of the wear powder with the small particle diameter.

With the inner-surface cleaning member 201, the wear powder with the large particle diameter is removed mostly by the contact member 201*a* at a portion around an upstream end in the moving direction of the endless belt 103 (the direction indicated by arrow E) in the contact region A-B shown in FIGS. 6A and 6B. At this time, major part of the wear powder with the small particle diameter passes through the portion around the upstream end because of insufficiency in contact pressure. The passed wear powder with the small particle diameter is removed by the contact member 201*a* at the portion around the downstream end in the moving direction of the endless belt 103 (in the direction indicated by arrow E) in the contact region A-B.

Also, as described above, with the inner-surface cleaning member 201, the relatively large contact pressure sufficient for the removal of the wear powder with the small particle diameter is provided only at the downstream end portion in the moving direction of the endless belt 103 (in the direction indicated by arrow E) in the contact region A-B shown in FIGS. 6A and 6B. If the contact pressure in the entire contact region A-B is the large contact pressure, wear may occur between the inner-surface cleaning member 201 and the inner surface of the endless belt 103. With the inner-surface cleaning member 201, the portion with the large contact pressure is limited. Hence, occurrence of wear is restricted.

Further, with the inner-surface cleaning member 201, the contact pressure at the upstream end portion in the moving direction of the endless belt 103 (in the direction indicated by arrow E) in the contact region A-B is restricted to be a relatively small contact pressure sufficient for the removal of the wear powder with the large particle diameter. If the contact pressure at the upstream end portion is the relatively large contact pressure sufficient for the removal of the wear powder with the small particle diameter, the amount of the wear powder that is removed at the portion around the upstream end becomes excessively large. Then, the wear powder is accumulated at the portion around the upstream end of the contact member 201*a* by an amount larger than a permissible amount in a short period of time. As the result, the life of the inner-surface cleaning member 201 may become short.

In contrast, with the inner-surface cleaning member 201, the wear powder with the large particle diameter is removed mostly by the portion around the upstream end of the contact member 201*a*, and the wear powder with the small particle diameter is removed by the portion around the downstream end of the contact member 201*a*. As described above, with the inner-surface cleaning member 201, the portion at which the wear powder is accumulated in the contact member 201*a* is dispersed, and a local increase in accumulation amount of the wear powder is restricted.

Also, with the inner-surface cleaning member 201, the above-described contact-pressure distribution is provided by a simple structure of the shape of the recess 201*b*_1 of the holding member 201*b* to which the contact member 201*a* is fitted. Further, obtaining the holding member 201*b* having the shape shown in FIG. 5 by processing resin or metal is cheaper than obtaining the contact member 116*a* according to the first exemplary embodiment having the shape shown in FIG. 3 by processing the foam material.

In the above-described second exemplary embodiment, the distribution in which the pressure gradually increases from the upstream end portion to the downstream end portion of the contact member in the moving direction of the endless belt is provided as an example of a press-pressure distribution according to an exemplary embodiment of the present invention. However, the press-pressure distribution according to an exemplary embodiment of the present invention is not limited thereto. The press-pressure distribution may be a distribution in which the press pressure gradually increases from both ends to the center portion of the contact member in the moving direction of the endless belt and becomes the maximum at the center portion. The press-pressure distribution is provided, for example, by the holding member with the recess, to which the contact member is fitted, and the depth of which gradually decreases from both ends to the center portion in the moving direction of the endless belt. Also, the press-pressure distribution according to an exemplary embodiment of the present invention may be a distribution in a step form in which the press pressure at a portion located downstream of the most upstream portion in the moving direction of the endless belt is locally larger than that of the other portion. The press-pressure distribution in the step form is provided by a holding member or the like having a step structure in which the recess, to which the contact member is fitted, locally decreases at a portion located downstream of the most upstream portion in the moving direction of the endless belt.

In any of the first and second exemplary embodiments, the arrangement in which the shape of only one of the contact member and the holding member is through out to obtain the contact-pressure distribution according to an exemplary embodiment of the present invention. However, the arrangement to obtain the contact-pressure distribution according to an exemplary embodiment of the present invention may be an arrangement in which the shapes of both the contact member and the holding member are through out.

In any of the above-described first and second exemplary embodiments, the heaters are respectively provided in the tension roller, the fixing pad, the external heat roller, and the fixing roller. However, in the fixing device, for example, a heater that is provided one of the tension roller, the fixing pad, the external heat roller, and the fixing roller may heat the endless belt.

Also, in any of the first and second exemplary embodiments, the tandem color printer is used as an example of an image forming apparatus according to an exemplary embodiment of the present invention. However, the image forming apparatus according to an exemplary embodiment of the present invention may be a rotary color printer in which plural developing units are arranged around the rotation axis, or may be a monochrome printer. Also, the image forming apparatus according to an exemplary embodiment of the present invention is not limited to the printer, and may be a copier, a facsimile, or the like.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device, comprising:

a heat assembly including an endless belt that moves in a circulation manner and has an inner surface and an outer surface, a heat source that heats the endless belt, a pressure pad that is pressed to the inner surface of the endless belt, and a cleaning member that cleans the inner surface of the endless belt by contacting the inner surface and sliding on the inner surface as the result of the circulation movement of the endless belt; and a pressure member that presses the outer surface of the endless belt to the pressure pad, receives a medium that holds an unfixed toner image between the pressure member and the endless belt, and fixes the toner image to the medium in cooperation with the heat assembly, wherein the cleaning member contacts the endless belt with a contact-pressure distribution such that a contact pressure of a portion located downstream of a most upstream portion in a moving direction of the endless belt is the maximum in a contact region where the cleaning member contacts the endless belt.

2. The fixing device according to claim 1, wherein the cleaning member includes a contact member that contacts the inner surface of the endless belt, and a holding member that holds the contact member and presses the contact member to the inner surface of the endless belt, and wherein the contact member has a thickness distribution in the moving direction, is elastically deformed to contact the inner surface in the contact region when the contact member is pressed to the inner surface of the endless belt, and hence forms the contact-pressure distribution.

3. The fixing device according to claim 1, wherein the cleaning member includes a contact member that contacts the inner surface of the endless belt, and a holding member that holds the contact member and presses the contact member to the inner surface of the endless belt, and wherein the holding member presses the contact member to the inner surface of the endless belt with a press-pressure distribution, and hence forms the contact-pressure distribution.

4. An image forming apparatus, comprising:

an image forming unit that forms an electrostatic latent image, forms a toner image by developing the electrostatic latent image with a toner, and passes the toner image to a medium; and a fixing unit that fixes the unfixed toner image passed to the medium onto the medium, wherein the fixing unit includes a heat assembly including an endless belt that moves in a circulation manner and has an inner surface and an outer surface, a heat source that heats the endless belt, a pressure pad that is pressed to the inner surface of the endless belt, and a cleaning member that cleans the inner surface of the endless belt by contacting the inner surface and sliding on the inner surface as the result of the circulation movement of the endless belt; and a pressure member that presses the outer surface of the endless belt to the pressure pad, receives a medium that holds an unfixed toner image between the pressure member and the endless belt, and fixes the toner image to the medium in cooperation with the heat assembly, wherein the cleaning member contacts the endless belt with a contact-pressure distribution such that a contact pressure of a portion located downstream of a most upstream portion in a moving direction of the endless belt is the maximum in a contact region where the cleaning member contacts the endless belt.

* * * * *